US010994185B2

(12) United States Patent
Walton

(10) Patent No.: US 10,994,185 B2
(45) Date of Patent: May 4, 2021

(54) PUTT RULER

(71) Applicant: Robert H. Walton, Hilton Head Island, SC (US)

(72) Inventor: Robert H. Walton, Hilton Head Island, SC (US)

( * ) Notice: Subject to any disclaimer, the term of this patent is extended or adjusted under 35 U.S.C. 154(b) by 0 days.

(21) Appl. No.: 16/792,782

(22) Filed: Feb. 17, 2020

(65) Prior Publication Data

US 2020/0179783 A1 Jun. 11, 2020

Related U.S. Application Data

(62) Division of application No. 15/986,000, filed on May 22, 2018, now abandoned.

(51) Int. Cl.
*A63B 69/36* (2006.01)

(52) U.S. Cl.
CPC ..... *A63B 69/3685* (2013.01); *A63B 69/3632* (2013.01); *A63B 2225/09* (2013.01)

(58) Field of Classification Search
CPC ..... A63B 69/3685; A63B 69/3632; A63B 2225/09; A63B 69/3676; A63B 57/10; A63B 2220/20; A63B 2071/0694; A63B 2071/024; A63B 69/3623; A63B 69/3655; A63B 69/3661; A63B 69/3641; A63B 69/36
USPC ..... 473/387–403, 404, 405, 407; D21/791, D21/792
See application file for complete search history.

(56) References Cited

U.S. PATENT DOCUMENTS

| | | | | |
|---|---|---|---|---|
| 1,484,064 | A | 2/1924 | Charley et al. | |
| 1,616,059 | A | 2/1927 | Mulvehill | |
| 1,638,527 | A | 8/1927 | George | |
| 1,936,625 | A | 11/1933 | Benjamin | |
| 1,959,347 | A | 5/1934 | Czichos | |
| 2,165,479 | A | 7/1939 | Theodore | |
| 3,406,977 | A | 10/1968 | Voelkerding | |
| 3,473,812 | A * | 10/1969 | Pelzman | A63B 57/10 473/278 |
| 3,675,929 | A | 7/1972 | Guarino | |
| 3,934,882 | A | 1/1976 | Whittaker | |
| 4,384,718 | A | 5/1983 | Cachola | |
| 4,544,161 | A | 10/1985 | Guendling | |
| 4,953,865 | A | 9/1990 | Coombs et al. | |
| D354,107 | S | 1/1995 | Kueng et al. | |

(Continued)

OTHER PUBLICATIONS

Extra Spin Staff, "Pros Take Aim at 200-Yard Par-3, Teein Off With Putter", <https://golf.com/news/pros-take-aim-at-200-yard-par-3-teeing-off-with-putter/>, Jul. 10, 2016, retrieved on Sep. 25, 2020. (Year: 2016).*

(Continued)

*Primary Examiner* — Steven B Wong

(57) ABSTRACT

A putt ruler is a device that separates the skills of straight-line putting from reading the green. The putt ruler may be affixed to the golf green and may be rotated to align with the identified target line. Through placement of two golf balls atop the putt ruler, a golfer may produce a putt that follows a straight line, when the stroke used may not have produced a straight-line putt on a single golf ball. The golfer may then evaluate the chosen target line in relation to the resultant putt and evaluate the speed of the putt as the ball travels along the playing surface.

10 Claims, 11 Drawing Sheets

(56) References Cited

U.S. PATENT DOCUMENTS

| | | | | |
|---|---|---|---|---|
| 5,595,546 | A * | 1/1997 | Masters | A63B 69/3688 473/280 |
| 5,772,204 | A | 6/1998 | Phelps | |
| D406,298 | S | 3/1999 | Murphy | |
| D462,734 | S | 9/2002 | Pelz | |
| 6,634,955 | B2 * | 10/2003 | Middleton | A63B 53/0487 473/231 |
| 6,840,870 | B1 * | 1/2005 | Froggatte | A63B 24/0003 473/265 |
| D520,096 | S | 5/2006 | Prestwich | |
| 7,066,827 | B2 | 6/2006 | Stringer | |
| 7,077,759 | B1 * | 7/2006 | McNulty | A63B 69/3676 473/257 |
| D596,260 | S | 7/2009 | Hall | |
| D635,214 | S | 3/2011 | Johansen | |
| D640,763 | S | 6/2011 | Jones et al. | |
| D641,448 | S | 7/2011 | Sessions | |
| D672,001 | S | 12/2012 | Whitfield | |
| D692,512 | S | 10/2013 | Fanfelle | |
| D696,371 | S * | 12/2013 | Wilkie | D21/791 |
| D756,477 | S | 5/2016 | Chorne | |
| 9,474,951 | B2 * | 10/2016 | Chuang | A63B 57/19 |
| 9,937,404 | B2 | 4/2018 | Yahnite | |
| 2005/0009645 | A1 | 1/2005 | Isabell | |
| 2006/0019763 | A1 | 1/2006 | Anderson | |
| 2007/0004538 | A1 * | 1/2007 | Lim | A63B 57/10 473/387 |
| 2008/0102973 | A1 * | 5/2008 | Bennett | A63B 69/3667 473/261 |
| 2010/0035699 | A1 | 2/2010 | Sorenson | |
| 2012/0100924 | A1 | 4/2012 | Covino | |
| 2018/0154228 | A1 | 6/2018 | Louwrens | |
| 2019/0358513 | A1 | 11/2019 | Walton | |

OTHER PUBLICATIONS

"Final Office Action issued in U.S. Appl. No. 15/986,000, filed May 22, 2018", dated Oct. 18, 2019.

"Office Action issued in U.S. Appl. No. 15/986,000, filed May 22, 2018", dated May 24, 2019, 14 pages.

* cited by examiner

PUTT RULER

REFERENCE TO RELATED APPLICATION

This application is a divisional of and claims priority to U.S. patent application Ser. No. 15/986,000 filed May 22, 2018 and entitled "Putt Ruler." The entire contents of the above-identified application are hereby fully incorporated herein by reference.

TECHNICAL FIELD

The present disclosure relates to a golf training device to teach golfers how to understand and control the roll of a golf ball in the game of golf. The device provides a method for producing a straight putt allowing the golfer to focus on how to read putts, control the distance of putts, contact the ball on the center of the clubface, and develop a consistent putting stroke.

BACKGROUND

The game of golf includes two parts: the long-range stroke and the short-range stroke. The goal for each hole of golf is to place the golf ball into the hole in as few strokes as possible. To be successful at the short-range portion of the game of golf, one must be able to putt straight and read a green. Reading a green encompasses imagining, visualizing, picturing, or foreseeing the speed and line on which the golf ball will roll once struck. A putt may need to travel in a straight line to land the golf ball in the hole however most putts will break. Breaking means that even while the initial path of the putt is straight, the putt will veer either to the right or the left of the initial straight line of the putt due to changes in the surface of the green. The challenge to successful putting occurs when golfers have not yet acquired the skill to putt straight and read the green. The ability to read a green and successfully execute requires the control of both the strength of the putt and the direction of the putt.

A need exists for a device to allow golfers to putt straight and thereby read the green from the resulting putt.

SUMMARY

Techniques herein provide a putt ruler to deliver a straight-line putt onto a golf course green. The short-range putting portion of the game of golf requires the skills of putting along a straight-line and the ability to read the green. Reading a green requires the ability to visualize the path of the golf ball as it encounters changes in elevation, grass length, moisture levels, wind, and other variable elements on the golf course. Through fundamental physics, the putt ruler allows a golfer to strike a first golf ball, have the first golf ball transfer force into a second golf ball, the second golf ball then traveling along a straight-line path defined by the center of the two golf balls as the two golf balls are placed on the putt ruler until the second golf ball encounters a change in curvature or other variable element on the golf course green. The putt ruler separates, to a great extent, the skills of straight-line putting from reading the green. The putt ruler allows a golfer to focus on the elements of the sport required to read a green.

After a golfer has read the green and determined a desired path or target line for the ball to follow, the golfer may then direct the putt ruler along the target line. The putt ruler may be affixed to the ground by inserting a peg and rotating the putt ruler about that peg to align the putt ruler with the target line selected. Two golf balls may then be seated atop the putt ruler. Seating a golf ball refers to placing a golf ball into a hole, dimple, or other suitable indentation in the putt ruler such that the golf ball remains stationary. The golfer may then strike the first golf ball with a putter, the force from the putter will be transferred from the first ball to the second ball causing the second ball to move in a path along the target line.

In certain other example aspects described herein, methods to utilize the ruler are provided.

These and other aspects, objects, features, and advantages of the example embodiments will become apparent to those having ordinary skill in the art upon consideration of the following detailed description of illustrated example embodiments.

DETAILED DESCRIPTION OF EXAMPLE EMBODIMENTS

Overview

Figure 1:
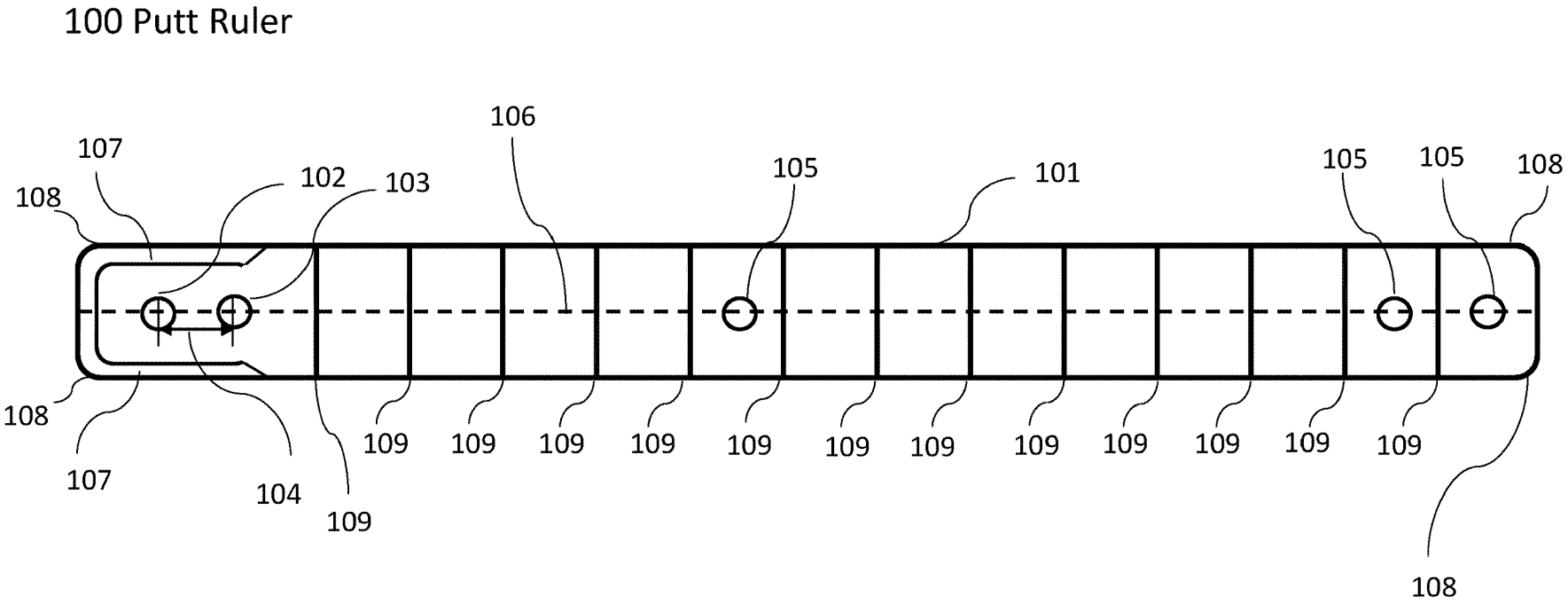
FIG. 1 is an illustration depicting a top perspective view of a putt ruler, which indicates locations for two golf balls, in accordance with certain example embodiments.

The example embodiments described herein provide a putt ruler for use as a golf training device. The putt ruler utilizes a transfer of force from a first ball to a second ball to allow a golfer to achieve a straight putt along a target line, which will place a golf ball in close proximity or into the hole.

The putt ruler is a golf training device. The purpose of the putt ruler is to assist a golfer in learning how to read a green, control the distance of putts, contact the golf ball on the center of the clubface, and develop a consistent putting stroke that will reliably send a golf ball down a chosen target line. Reading a green requires the ability to visualize the path of a golf ball as it encounters changes in elevation, grass length, moisture levels, wind, and other variable elements on the golf course.

In an example, a putt ruler is a flat, rectangularly-shaped device with two drilled holes at one end of the device. In other examples, the putt ruler may be a different shape, such as oblong, round, or oval. In other examples, the putt ruler may have any other suitable shape desired. The two holes are located along the longitudinal center of the putt ruler. The holes may alternatively be an indention or any other suitable cavity. The first hole is of uniform diameter. A first golf ball, the stroke ball, is seated in this hole.

The second hole is drilled such that a tapered peg may be inserted into the hole to affix the putt ruler to the ground. A putt ruler may be rotated 360° around the vertical axis of the peg allowing the ruler to be aimed in any direction thereby choosing any target line along the green.

The top of the peg after being inserted into the second hole may fall just beneath the surface of the putt ruler. A golf ball, the play ball, is seated in this hole. The holes are precisely spaced such that when both holes are seated with golf balls, the golf balls will slightly touch.

The method to use a putt ruler is for a golfer to read the green, rotate the putt ruler about an inserted peg to the align with the chosen target line, then seat two golf balls onto the putt ruler. The golfer may then strike the stroke ball with a putter. The force from the putter will be transferred from the stroke ball to the play ball, which will then roll along the chosen target line to which the putt ruler was aligned. After putting, the golfer may be able to visualize if the correct target line was chosen and if the putt had the correct speed required to reach the hole.

A putt ruler may be manufactured from several different materials such as plastic, metal, wood, or any other suitable material. A putt ruler may be manufactured using techniques such as stamping, injection molding, 3D printing, laser cutting, or any other suitable technique.

The physical dimensions of a putt ruler may be altered to create different embodiments. Holes, lines, rounded corners, and beveled edges may be relocated, added, or omitted to create different embodiments of a putt ruler.

DETAILED DESCRIPTION

Turning now to the drawings, in which like numerals represent like (but not necessarily identical) elements throughout the figures, example embodiments of the present technology are described in detail.

FIG. 1 is an illustration depicting a top perspective view of an example putt ruler 101. This example putt ruler 101 would be appropriate for use with two standard golf balls. In an example, the dimensions of the putt ruler 101 are 2 inches wide, 17 inches long, and 0.25 inches high. FIG. 1 illustrates a hole 102 drilled through the putt ruler 101 such that the hole 102 is tapered from the top of the putt ruler 101 with 0.25-inch diameter to the bottom of the putt ruler 101 with 0.15-inch diameter. The requirement for the tapered play ball hole 102 will be further discussed in reference to FIG. 3.

FIG. 1 illustrates a hole 103 of uniform diameter 0.25 inches drilled through putt ruler 101. The center to center distance 104 from the center of the top of hole 102 to the center of the top of hole 103 is substantially 1.68 inches, which is the diameter of a standard golf ball. Additional holes 105 may be drilled through putt ruler 101 at other suitable locations. Holes 102, 103, and 105 are located along the longitudinal center 106 of the putt ruler 101. In an alternate example, a different center to center distance 104 may be utilized to accommodate balls of a different diameter. Alternatively, the center to center distance 104 may vary slightly if a user desires that one ball sits higher on the putt ruler than a second ball. Alternatively, the center to center distance 104 may be slightly shorter than the diameter of the balls to ensure that the balls share a point of contact.

These dimensions are merely examples and other dimensions could be utilized. For example, the putt ruler could be 10, 12, or 20 inches long. Different spacing between holes 102 and 103 could be utilized to accommodate different size balls. The spacing between the holes provides that the balls will remain in contact when seated in the holes, therefore the spacing between the holes will be equal to the diameter of one of the balls, with the balls being of the same diameter. A different width of the putt ruler 101 could be utilized such as 2.5 or 3 inches. A different height of the putt ruler 101 could be utilized such as 0.2 or 0.3 inches. In an example, the height of the putt ruler 101 remains small in magnitude to prevent the play ball from bouncing as it rolls off the end of the putt ruler 101. In another example, the edge of the putt ruler is sloped to allow a smooth transition of the ball to the playing surface. Other suitable examples may be utilized to assist the transition of the ball to the playing surface.

The putt ruler 101 may include beveled edges 107, rounded corners 108, and vertical lines 109. The vertical lines 109 may be spaced 1.0 inches from center of line to center of line such that the putt ruler 101 may be used as a measurement device. Other suitable spacing from center to center of the vertical lines 109 may be used such as 0.25 or 0.5 inches such that the putt ruler 101 may still be used as a measurement device.

Figure 2:
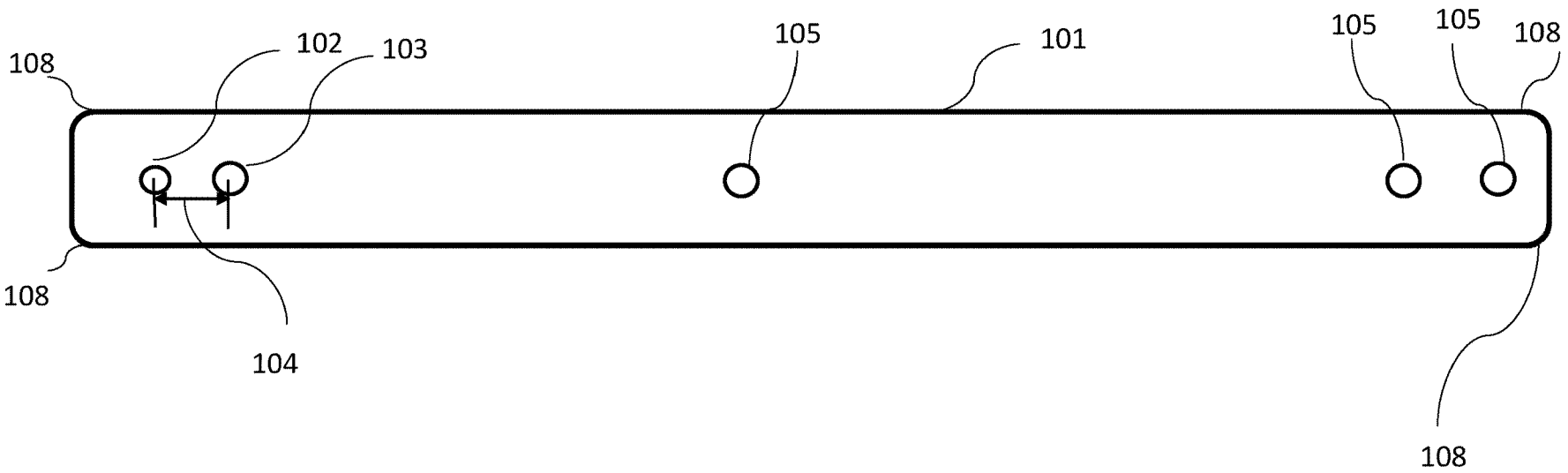
FIG. 2 is an illustration depicting a bottom perspective view of a putt ruler, in accordance with certain example embodiments.

FIG. 2 is an illustration depicting a bottom perspective view of the putt ruler 101. In the example, the diameter of hole 102 on the bottom surface of putt ruler 101 is depicted as being smaller than the diameter of hole 103. Hole 102 is tapered from the top of the putt ruler 101 to the bottom of putt ruler 101. Hole 103 is of uniform diameter from the top to the bottom surface of the putt ruler 101. In an example, the dimension of hole 102 is tapered from 0.25 inches to 0.15 inches.

Figure 3:
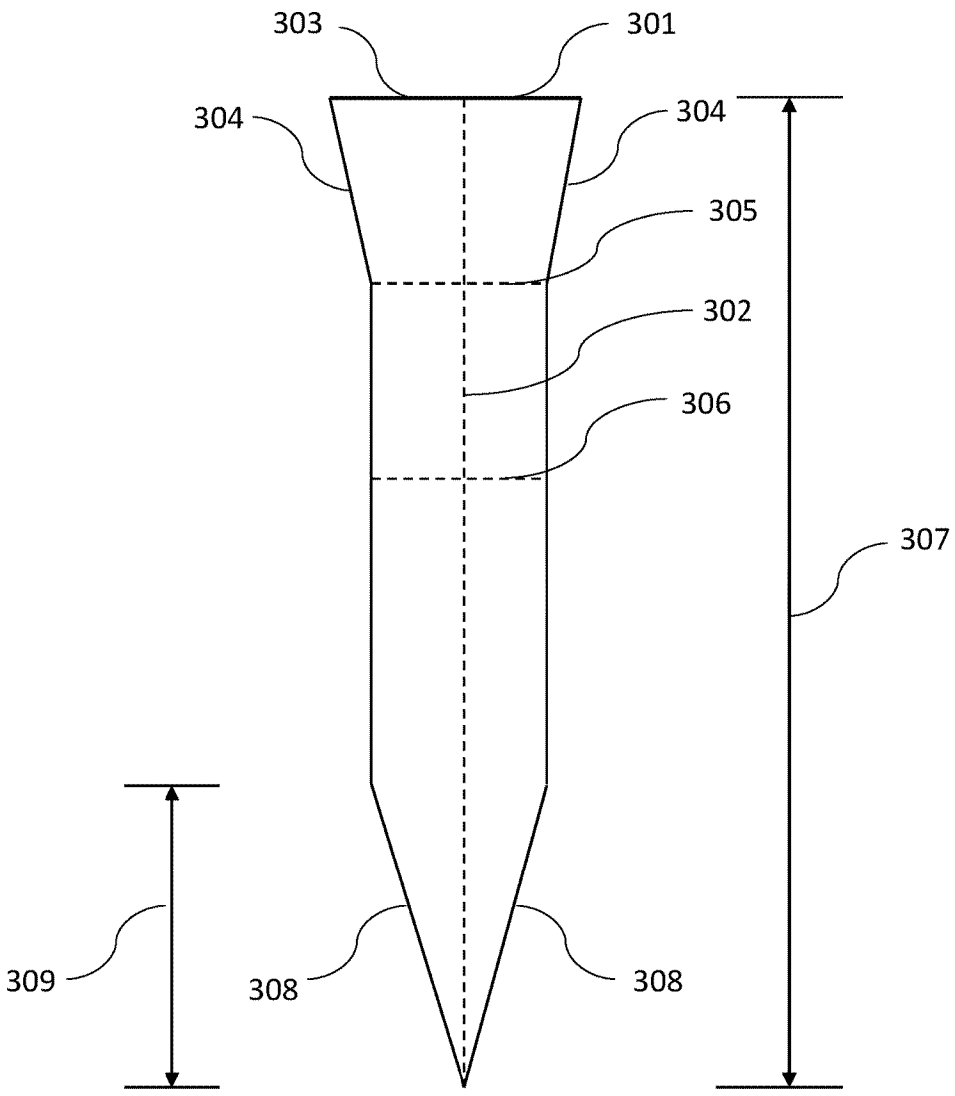
FIG. 3 is an illustration depicting a front perspective view of a drop-in peg used to secure a putt ruler to the surface of a green.

FIG. 3 is an illustration depicting a front perspective view of a drop-in peg 301 used to secure the putt ruler 101 to the ground, a putting green, or any other suitable playing surface. The putt ruler 101 may be rotated 360° around the vertical axis 302 of the drop-in peg 301 allowing the putt ruler 101 to be aimed in any direction thereby choosing any target line along the green. Example dimensions for drop-in peg 301 may be a 0.25-inch cross sectional diameter 303 along the top edge of drop-in peg 301. The width of drop-in peg 301 has tapered sides 304 which transition the 0.25-inch cross sectional diameter to a 0.15-inch cross sectional diameter 305. A slight taper continues until a 0.149-inch cross sectional diameter 306 is obtained. The height 307 of drop-in peg 301 is 1.2 inches. A final tapering 308 occurs on drop-in peg 301 beginning at a location of 0.25 inches from the bottom tip of the of drop-in peg 301, as shown in dimension 309.

In an alternate example, the peg 301 is permanently affixed to the putt ruler 101. That is, the peg 301 is not inserted into the hole, but is affixed to the putt ruler 101 and protrudes out of the bottom surface of the putt ruler 101 to allow the peg 301 to secure the putt ruler 101 to the surface of the green.

In another example, the peg 301 is a screw in peg. The peg 301 includes threads that match threads in the putt ruler 101. A user is able to screw the peg 301 into the putt ruler 101 to semi-permanently affix the peg 301 to the putt ruler 101. The peg 301 may screw into hole 102, hole 103, or any other suitable threaded hole in the putt ruler 101.

Figure 4:
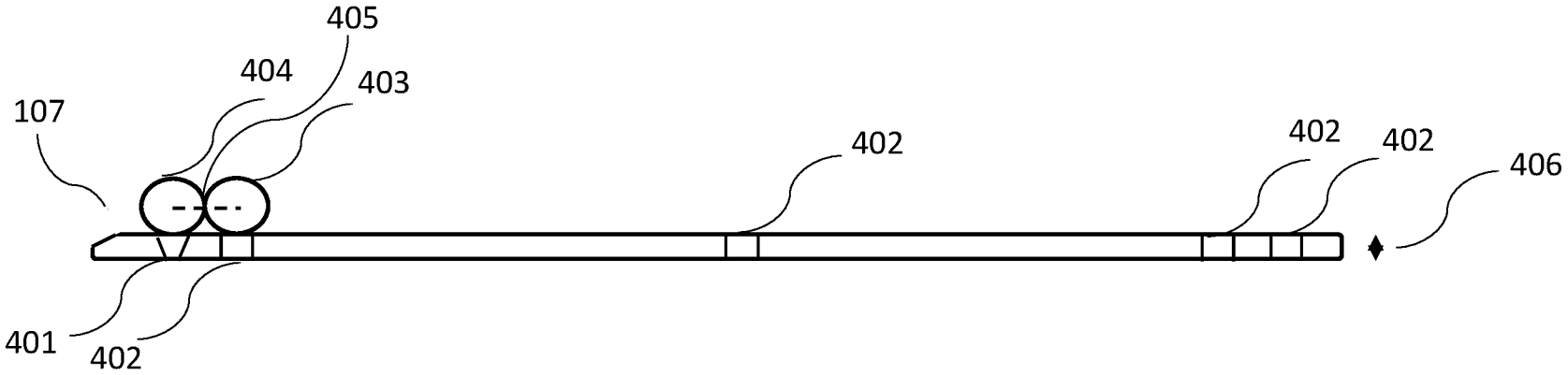
FIG. 4 is an illustration depicting a cross section of a side view of a putt ruler with drilled holes and uniform cross section height.

FIG. 4 is an illustration depicting a cross section of a right side perspective view of a putt ruler 101. Reference 401 is a view illustrating the tapering of the diameter of hole 102 beginning at the top surface of putt ruler 101. Reference 402 illustrates the uniform diameter of holes 103 and 105. Golf ball one 403 is illustrated seated into hole 103. Golf ball two 404 is illustrated seated into hole 102. Golf ball one 403 is in contact with golf ball two 404 at the point where the two golf balls touch on the lateral line 405 connecting the centers of the two golf balls. Golf ball one 403 and golf ball two 404 share a point of contact because golf ball one 403 and golf ball two 404 are placed in cavities that are substantially the same distance apart as the diameter of each of golf ball one 403 and golf ball two 404.

Golf ball one 403 is designated as the stroke ball as it will be the golf ball to which the putter 501 makes contact. The putter 501 will be further described in FIG. 5. Golf ball two 404 is designated as the play ball as its motion will begin on the putt ruler 101 and continue onto the golf course green. The contact between the putter 501, golf ball one 403 and golf ball two 404 will be addressed in further detail in subsequent figures.

FIG. 4 illustrates a uniform height 406 of the putt ruler 101. An example height may be 0.25 inches but other suitable heights may be used.

FIG. 4 illustrates a beveled edge 107 from a side perspective view. The beveled edge 107 may allow golf ball two 404 to make a smooth transition onto the golf course green.

Figure 5:
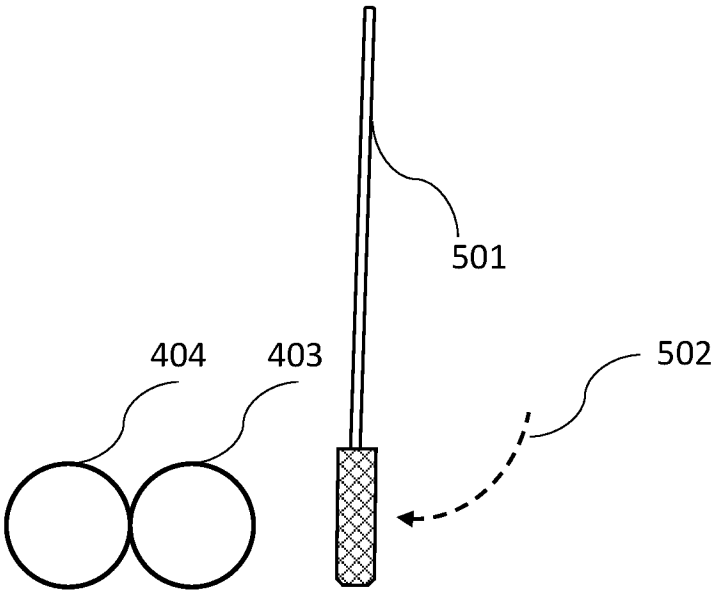
FIG. 5 is an illustration depicting a putter as it makes contact with a first golf ball.

FIG. 5 illustrates a side perspective view of a putter 501 and the back swing 502 of the putter 501 as it contacts golf ball one 403.

Figure 6:
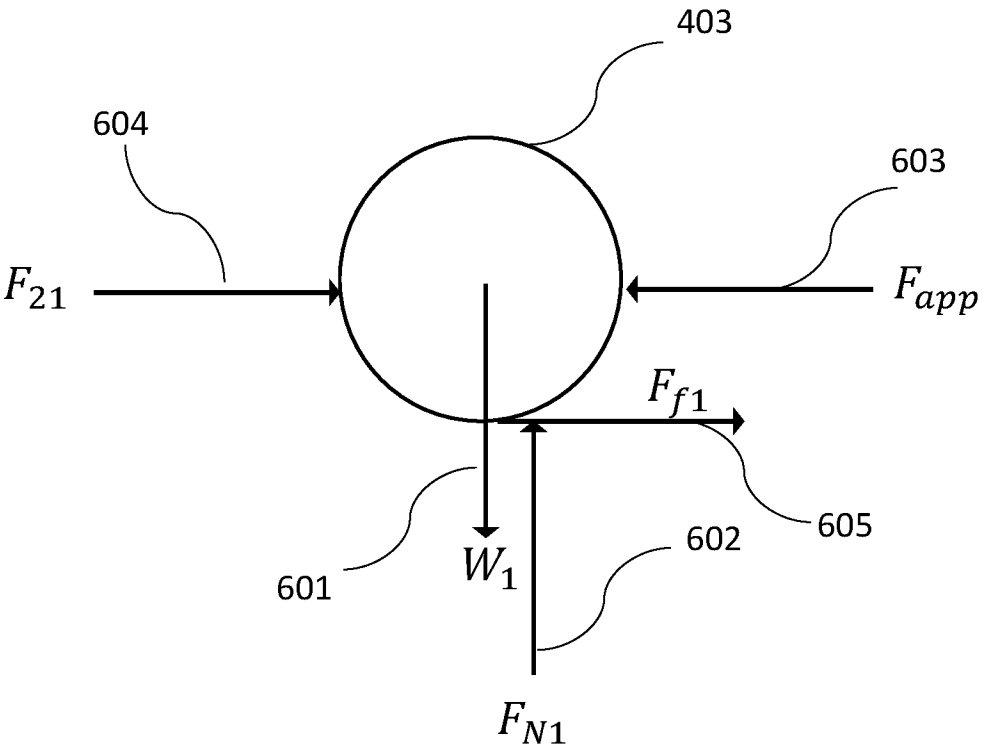
FIG. 6 is an illustration depicting the forces acting on a golf ball after contact with a putter wherein the force from the putter is normal to the surface containing the contact point of the golf ball.

FIG. 6 is a free body diagram depicting the forces acting upon golf ball one 403 as contact is made with putter 501. Forces are vector quantities meaning they have a magnitude and a direction. The arrows for each force indicate the direction of the force as applied to golf ball one 403. The magnitude of each force, which would be the length of the arrowed line, are not drawn to scale. The forces acting upon golf ball one 403 include the weight ($W_1$) 601, the normal force ($F_{N1}$) 602, the applied force from the putter ($F_{app}$) 603, the reaction force from golf ball two 404 ($F_{21}$) 604 onto golf ball one 403, and the frictional force ($F_{f1}$) 605 between golf ball one 403 and the surface with which it is in contact.

The weight 601 and the normal force 602 are both in a direction normal to the surface onto which golf ball one 403 is located. There is no net motion in the direction normal to the surface, therefore those forces are equal in magnitude, opposite in direction, and do not directly affect the motion of golf ball one 403.

The applied force 603 is the force which causes motion in the system. The applied force 603 illustrated in FIG. 6 is the result of a preferred stroke. In a preferred stroke, the applied force 603 is normal to the plane containing the contact point on the surface of golf ball one 403. The plane is normal to the surface onto which golf ball one 403 is located. The direction of the applied force 603 is along the longitudinal center of the putt ruler 101. The frictional force 605 is in the opposite direction of the motion of golf ball one 403 thereby impeding the motion of the golf ball one 403.

The forces and subsequent motion of golf ball one 403 will be discussed in further detail with regards to FIG. 7.

Figure 7:
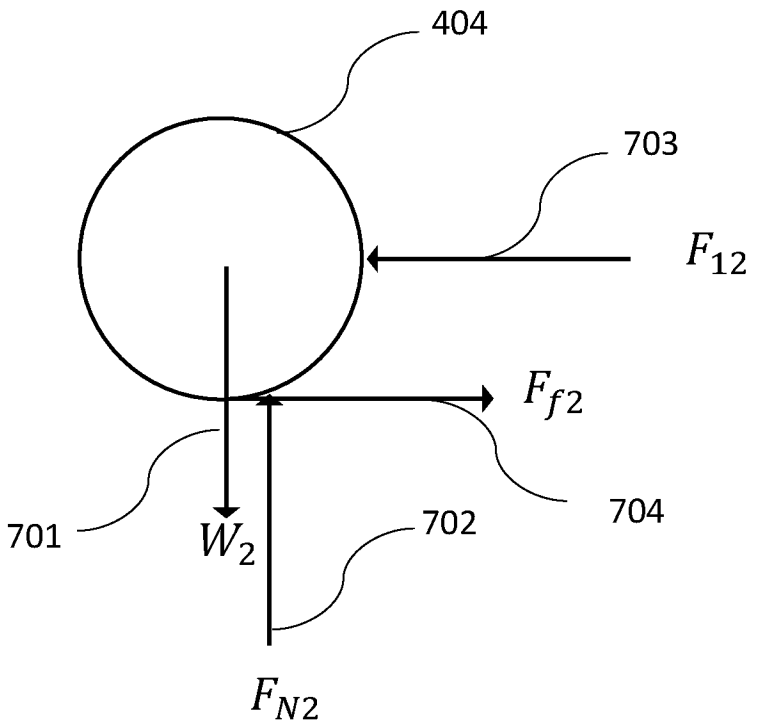
FIG. 7 is an illustration depicting the forces acting on a golf ball that has made contact with the golf ball from FIG. 6.

FIG. 7 is a free body diagram depicting the forces acting upon golf ball two 404 as a consequence of the applied force 603 to golf ball one 403 illustrated in FIG. 6. The forces acting upon golf ball two 404 include the weight ($W_2$) 701, the normal force ($F_{N2}$) 702, the reaction force from golf ball one 403 ($F_{12}$) 703 onto golf ball two 404, and the frictional force ($F_{f2}$) 704 between golf ball two 404 and the surface with which it is in contact.

The weight 701 and the normal force 702 are both in a direction normal to the surface onto which golf ball two 404 is located. There is no net motion in the direction normal to the surface, therefore those forces are equal in magnitude, opposite in direction, and do not directly affect the direction of the motion of golf ball two 404.

As the putter 501 contacts golf ball one 403, a force is applied to golf ball one 403 in the direction indicated in FIG. 6. Newton's third law states that for every force there is an equal and opposite reaction force. The applied force 603 is transferred from golf ball one 403 to golf ball two 404. The reaction forces $F_{21}$ 604 and $F_{12}$ 703 are equal in magnitude but opposite in direction.

The magnitude of reaction force $F_{12}$ 703 is less in magnitude than the applied force 603 due to energy lost to the frictional force $F_{f1}$ 605. According to Newton's second law of motion, the net force applied to an object will produce an acceleration or in equation form: $\Sigma\vec{F}=m\vec{a}$. The net force and the acceleration are vector quantities and therefore are in the same direction. The acceleration of golf ball two 404 according to Newton's second law must be in the same direction as the net force on golf ball two 404. The net force on golf ball two 404 is the difference between the reaction force $F_{12}$ and the frictional force $F_{f2}$ or in equation form: $\vec{F}_{net}=\vec{F}_{12}-\vec{F}_{f2}$. The motion of golf ball two 404 is in the direction of its acceleration, which is in the direction of the applied force 603, which is along the target line to which the putt ruler 101 is aligned.

Figure 8:
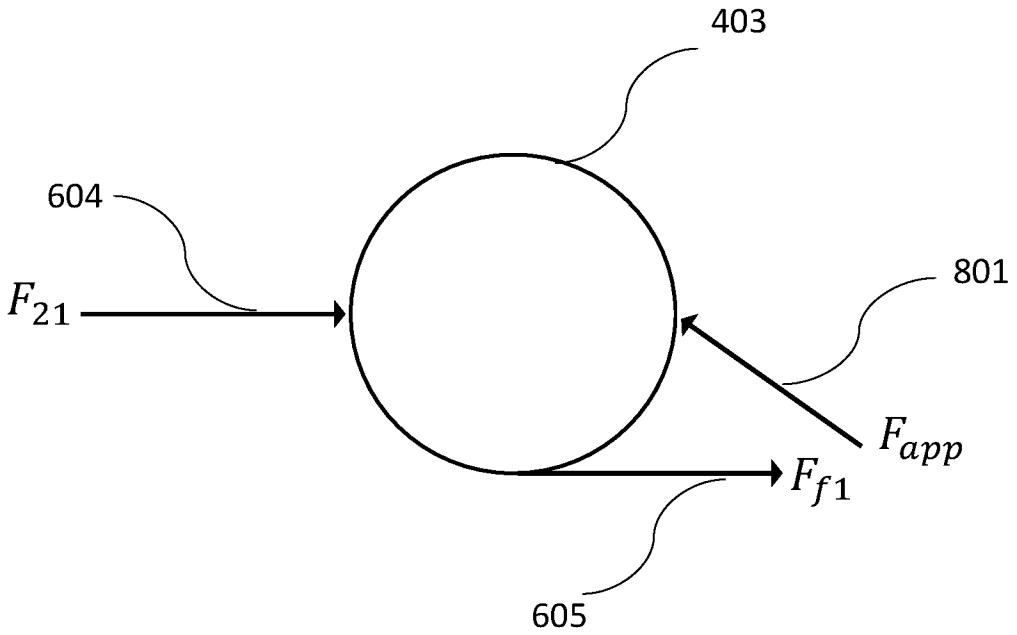
FIG. 8 is an illustration depicting the forces acting on a golf ball after contact with a putter wherein the force from the putter is directed at an angle relative to the surface containing the contact point of the golf ball.

FIG. 8 is a free body diagram depicting the forces acting upon golf ball one 403 as contact is made with putter 501. The weight ($W_1$) 601 and the normal force ($F_{N1}$) 602 are omitted from this figure as those forces do not directly affect the direction of the motion of golf ball one 403. FIG. 8 illustrates an applied force 801 at an angle to the plane containing the contact point on the surface of golf ball 403 as opposed to the applied force 603, which was normal to the plane containing the contact point on the surface of golf ball one 403. The direction of the applied force 801 is not in the longitudinal direction of the putt ruler 101.

FIGS. 6 and 7 illustrate an example of one-dimensional motion in that the applied force 603 is in the longitudinal direction of the putt ruler 101. FIG. 8 introduces an example of two-dimensional motion, which occurs when the force of the putter 501 is not applied in a line normal to the plane containing the contact point on the surface of golf ball one 403. The applied force 801 can be written in component form. Component form encompasses writing the force as a sum of two vectors, one in a longitudinal direction relative to the putt ruler 101 and one in a lateral direction relative to the putt ruler 101.

Figure 9:
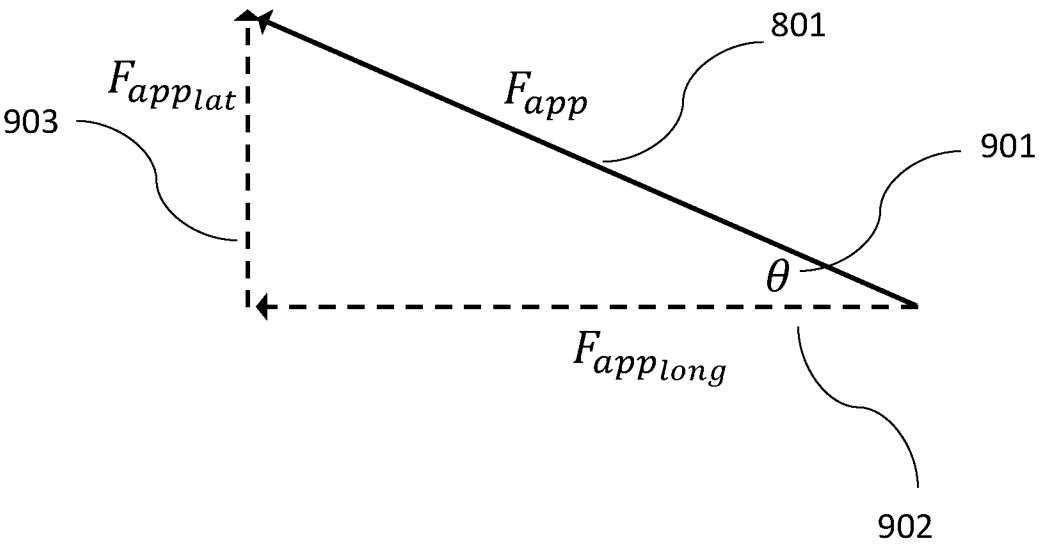
FIG. 9 is an illustration depicting the components of the force applied from the putter to the golf ball in both the longitudinal and lateral directions.

FIG. 9 illustrates the applied force 801, the angle 901 ($\theta$) of the applied force 801 relative to a line normal to the plane containing the contact point on the surface of golf ball one 403, the longitudinal component ($F_{app_{long}}$) 902 of the applied force 801, and the lateral component ($F_{app_{lat}}$) 903 of the applied force 801. The longitudinal component 902 of the applied force 801 is equal to the magnitude of the applied force 801 times the cosine of the angle 901 of the applied force 801 or in equation form: $\overrightarrow{F_{app_{long}}}=|F_{app}|\cos\theta$. The lateral component 903 of the applied force 801 is equal to the magnitude of the applied force 801 times the sine of the angle 901 of the applied force 801 or in equation form: $\overrightarrow{F_{app_{lat}}}=|F_{app}|\sin\theta$.

Newton's third law states that for every force there is an equal and opposite reaction force. The force of golf ball two 404 on golf ball one 403 is in a longitudinal direction relative to the putt ruler 101. Therefore, the force of golf ball one 403 on golf ball two 404 must be the same in magnitude but in the opposite direction. The magnitude of the force of golf ball one 403 on golf ball two 404, $F_{12}$ 703, is the difference between the longitudinal component 902 of the applied force 801 and the frictional force on golf ball one, $F_{f1}$ 605, or in equation form $\overrightarrow{F_{12}}=\overrightarrow{F_{app_{long}}}-\overrightarrow{F_{f1}}$.

Figure 10:
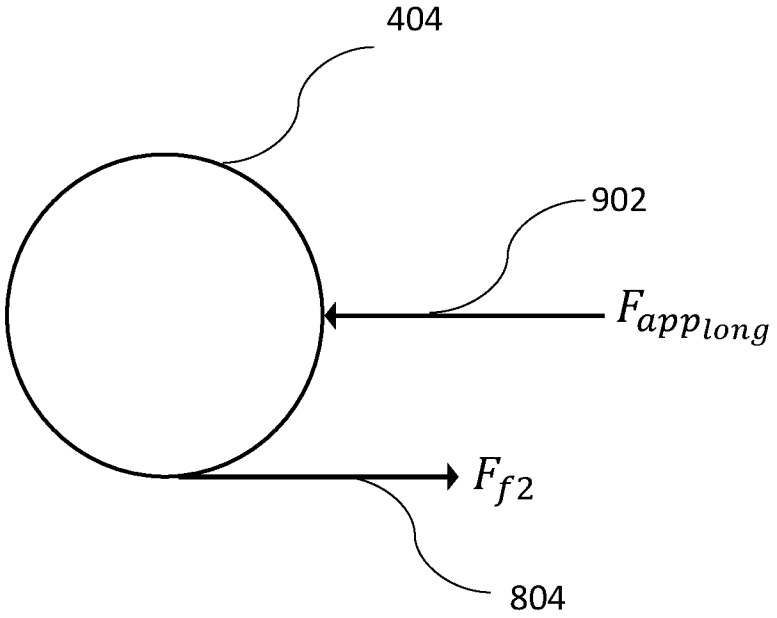
FIG. 10 is an illustration depicting the forces acting on a golf ball that has made contact with the golf ball from FIG. 8.

FIG. 10 is a free body diagram depicting the forces acting upon golf ball two 404 as a consequence of the force applied to golf ball one 403 illustrated in FIG. 8. The net force on golf ball two 404 is the difference between the reaction force $F_{12}$ and the frictional force $F_{f2}$ or in equation form: $\overrightarrow{F_{net}}=\overrightarrow{F_{12}}-\overrightarrow{F_{f2}}$. The motion of golf ball two 404 is in the direction of its acceleration, which is in the direction of the longitudinal component 902 of the applied force 801, which is along the target line to which the putt ruler 101 is aligned.

Figure 11:
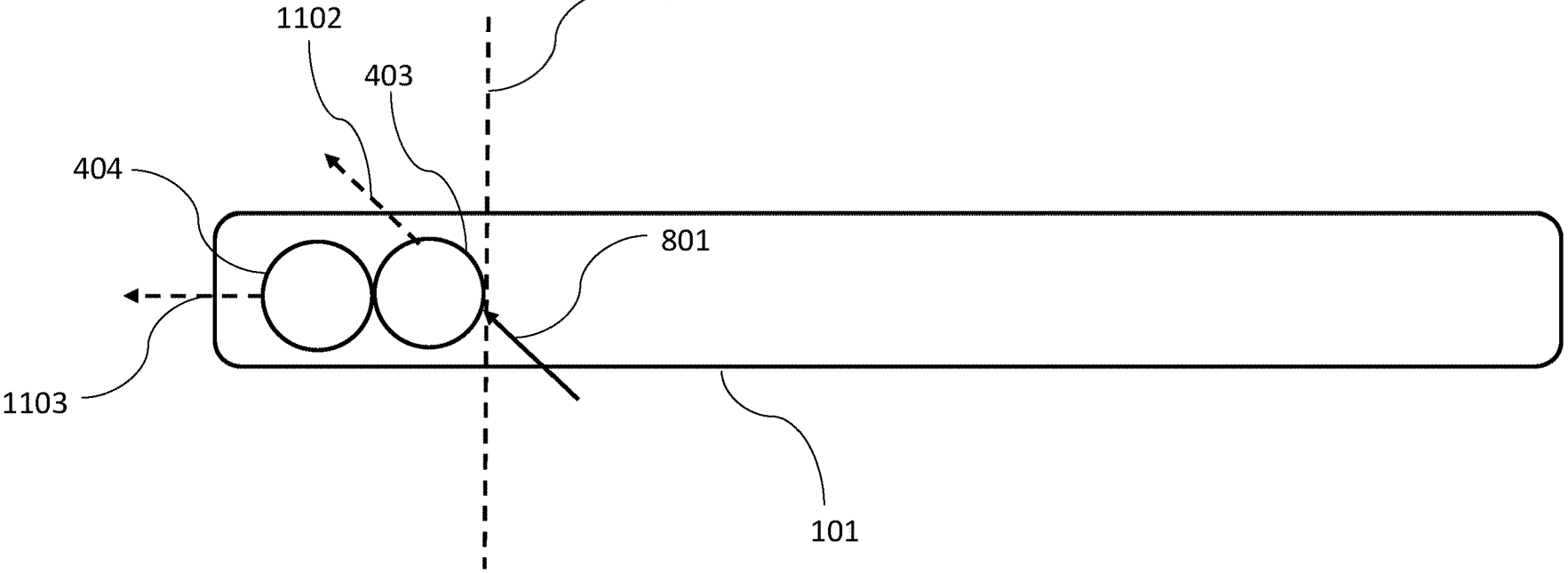
FIG. 11 is an illustration depicting a top perspective view of putt ruler 101 and the direction of motion of each golf ball as a result of a force from the putter directed at an angle relative to the surface containing the contact point of the golf ball.

FIG. 11 is a top view perspective of putt ruler 101 with golf ball one 403 and golf ball two 404 seated atop the putt ruler 101. Reference 1101 illustrates a plane normal to the line containing the contact point on the surface of ball one 403. The applied force 801 to golf ball one 403 is the force described in reference to FIG. 8. As the applied force 801 is at an angle relative to plane 1101, golf ball one 403 will travel along the direction indicated by reference 1102. Golf ball two 404 will travel along the direction indicated by reference 1103 according to the force analysis referenced in FIGS. 8 through 10.

Through the use of a putt ruler to develop reading and speed awareness skills, golfers tend to improve their ability to hit solid putts, and to find the path and putter angle that will send the golf ball on the intended target line. This development of skills may happen subconsciously through the use of a putt ruler, which is more desirable than spending years of training attempting to learn the correct putting technique. Even though a faulty stroke does not prevent the play ball from starting on the intended target line, a putt ruler will help identify the causes of a faulty stroke.

Due to the combined weight of the two golf balls against the putter upon impact, a golfer can recognize an off-center stroke more easily due to the vibration of the putter. For this reason, golfers tend to seek a stroke that will find the center of the putter face so as not to experience that vibration. This improves a golfer's ability to be consistent in hitting putts solidly, which in turn gives a consistent roll to the golf ball and thereby enables a golfer to learn speed control. A golfer that has a stroke in which the path of the putter does not follow the intended line at impact, or if the angle of the putter at impact is not perpendicular to the intended line, will feel the stroke ball slide off to one side of the play ball. The stroke ball will veer off to either the right or the left of the intended target line while the play ball will continue along the intended target line. As a result, a golfer will tend to seek a stroke that will send both balls along the target line, thereby developing a repeatable putting stroke that will send the putted ball along the chosen target line during play on the golf course.

The ability to read a golf course green is a combination of choosing a target line and a speed, which will enable the golf ball to land in the hole. Research has proven that on most golf course greens, a putt struck with sufficient speed to travel 17 inches beyond the hole before stopping has the greatest chance of landing in the hole. In order to help a golfer understand the travel distance, a putt ruler may be embodied so as to measure 17 inches in length. If a golfer's eyes are parallel to the target and directly over the stroke ball, a putt will deliver the optimal results for most players.

In the examples above, a putt ruler may be 2 inches wide and a golf ball is 1.68 inches in diameter, which makes it easy for a golfer to look down from the stroking position to determine where the golfer's eyes are in relation to the stroke ball. The putt ruler may include a red line behind the stroke ball that will indicate to a golfer where the golfer's eyes are in relation to the target line making it easy for the golfer to square the face of the putter along the target line. As a putt ruler may be 17 inches long, the putt ruler may be of sufficient length to provide a reference for the golfer to position the golfer's body and feet with respect to the target line.

What is claimed is:

1. A method to use a putt ruler, comprising:

reading a playing surface between an origin and a target to determine a vector from the origin toward the target;

placing a putt ruler on the playing surface, the putt ruler comprising a device with two cavities defined on a top surface of the putt ruler spaced such that one golf ball placed in one cavity contacts another golf ball placed in a second cavity, a line between the centers of the cavities defining an axis of the putt ruler;

aligning the axis of the putt ruler with the vector;

seating a first golf ball in the cavity farthest from the target and a second golf ball in the cavity nearest to the target, and the first golf ball and the second golf ball sharing a point of contact, the first golf ball and the second golf ball being standard sized golf balls;

applying a force to the surface of the first golf ball;

observing the motion of the second golf ball seated in the second hole as the second golf ball traverses the playing surface; and determining that the force applied to the surface of the first golf ball is not aligned with the axis of the putt ruler based on an observation that the first golf ball did not traverse the playing surface in the same direction as the second golf ball.

2. The method of claim 1, wherein placing the putt ruler comprises affixing the putt ruler to the surface of the green through the use of a tapered peg inserted into the first cavity.

3. The method of claim 2, wherein placing the putt ruler comprises rotating the putt ruler about an axis through the longitudinal center of the peg to a position such that a line along the putt ruler axis is aligned with the vector.

4. The method of claim 1, wherein placing the putt ruler comprises affixing the putt ruler to the surface of the green through the use of a peg that is located in line with the hole.

5. The method of claim 1, wherein the first golf ball and the second golf ball are seated atop the putt ruler by placing each golf ball on top of one of the cavities such that the first golf ball is in contact with the second golf ball at the point where the two balls touch along the lateral line connecting the centers of the two balls.

6. The method of claim 1, wherein the applied force is applied to the first golf ball through the use of a golf club, the applied force being transferred from the first golf ball to the golf second ball through the contact point, the motion of the second golf ball being along the target line to which the putt ruler was aligned.

7. The method of claim 1, further comprising determining that the force applied to the surface of the first golf ball is aligned with the axis of the putt ruler based on an observation that the first golf ball traversed the playing surface in the same direction as the second golf ball.

8. The method of claim 1, further comprising determining that the determined vector from the origin toward the target was properly selected based on whether the second ball arrives at the target.

9. A method to use a putt ruler, comprising:

reading a playing surface between an origin and a target to determine a vector from the origin toward the target;

placing a putt ruler on the playing surface, the putt ruler comprising a device with two cavities defined on a top surface of the putt ruler spaced such that one golf ball placed in one cavity contacts another golf ball placed in a second cavity, a line between the centers of the cavities defining an axis of the putt ruler;

aligning the axis of the putt ruler with the vector;

seating a first golf ball in the cavity farthest from the target and a second golf ball in the cavity nearest to the target, and the first golf ball and the second golf ball sharing a point of contact, the first golf ball and the second golf ball being standard sized golf balls;

applying a force to the surface of the first golf ball;

observing the motion of the second golf ball seated in the second hole as the second golf ball traverses the playing surface; and determining that the force applied to the surface of the first golf ball is aligned with the axis of the putt ruler based on an observation that the first golf ball traversed the playing surface in the same direction as the second golf ball.

10. The method of claim 9, further comprising determining that the force applied to the surface of the first golf ball is not aligned with the axis of the putt ruler based on an observation that the first golf ball did not traverse the playing surface in the same direction as the second golf ball.

* * * * *